United States Patent [19]

Frank

[11] 4,407,105

[45] Oct. 4, 1983

[54] MULTI-PANE INSULATING GLASS AND METHOD FOR ITS PRODUCTION

[76] Inventor: Wilhelm Frank, Rohrer Strasse 120, 7022 Leinfelden-Echterdingen 1, Fed. Rep. of Germany

[21] Appl. No.: 209,826

[22] Filed: Nov. 24, 1980

[30] Foreign Application Priority Data

Nov. 29, 1979 [DE] Fed. Rep. of Germany ..... 2948017
Nov. 29, 1979 [DE] Fed. Rep. of Germany ..... 2948018

[51] Int. Cl.[3] ..... E06B 3/66
[52] U.S. Cl. ..... 52/397; 52/17; 52/475; 52/656
[58] Field of Search ..... 52/397, 398, 399, 400, 52/171, 172, 788, 731

[56] References Cited

FOREIGN PATENT DOCUMENTS 1227943 3/1971 United Kingdom ..... 52/397

*Primary Examiner*—John E. Murtagh
*Attorney, Agent, or Firm*—McGlew and Tuttle

[57] ABSTRACT

A method of producing and arrangement for a multi-pane insulating glass structure which has two parallel panes, a frame for holding the panes and an adhesive sealant mounted between the panes and the frame, comprises specially-shaped elongated plastic sectional rods forming portions of the frame and having grooves for receiving the panes with a foil-type vapor seal mounted intermediate first and second ones of the sectional rod portions. The first rod portion is substantially U-shaped in cross-section and forms a spacer for the spaced parallel panes. The U-shaped sectional rod includes a central web for spanning the foil-type vapor seal and forming a chamber for housing a moisture-absorbing agent.

20 Claims, 8 Drawing Figures

MULTI-PANE INSULATING GLASS AND METHOD FOR ITS PRODUCTION

FIELD AND BACKGROUND OF THE INVENTION

The invention relates to a multi-pane insulating glass having at least two parallel panes which are surrounded by a frame formed by plastic sectional rods, each pane engaging by its edge in a glass-holding groove of the frame, and adhesive-sealant being present between at least a portion of the groove wall and the pane engaging therein, and the frame having a foil type vapor diffusion barrier or seal at least in the region of the space between the panes. While plastic sections offer diverse advantages over other materials, as for example wood, aluminum and the like, they are not vapor diffusion proof. For this reason, when plastic sectional rods are used for such a multi-pane insulating glass, a vapor seal must be provided which prevents or at least greatly hinders the penetration of water vapor into the space between the panes. In the known insulating glass, the vapor seal is embedded in the plastic sectional rod as the latter is being extruded. For one thing, this method of production is relatively expensive, and for another, leading the seal through to the edge of the sectional rod is a problem. Moreover, the form of the seal is determined to a large extent by the cross-sectional form of the plastic sectional rod, leading to a compromise in the realization of the vapor seal.

SUMMARY OF THE INVENTION

The technical problem of the invention is to provide a multi-pane insulating glass of the above-mentioned kind which combines an extremely simple and, hence, inexpensive construction with an especially good realization of the vapor seal for a frame which, except for the vapor seal, consists entirely of plastic.

For the solution of this problem the invention proposes that a multi-pane insulating glass of the type having at least two parallel panes which are surrounded by a frame formed by plastic sectional rods, each pane engaging by its edge in a glass-holding groove of the frame, an adhesive-sealant being present between at least a portion of the groove wall and the pane engaging therein, and the frame having a foil type vapor seal at least in the region of the space between the panes, characterized in that the plastic sectional rods are two-piece, and the foil type vapor seal is present between the two plastic sectional rod portions. The two-piece design of the plastic sectional rods obviates the expensive operation of embedding the vapor seal during extrusion of the plastic section. Instead, one places the foil type vapor seal on the one part of the sectional rod, then connects it with the other section part. The seal may, of course, extend over the full width of the space between the two panes. At one and the same cross-section of the plastic section, different designs of the vapor seal can be realized, and it is thus possible to select the most favorable form of the seal as a function, for example, of the design of the glass-holding grooves, the attachment of the glass panes in the plastic section, and/or other criteria. Polyvinyl chloride (PVC) the preferred material for the plastic sectional rods.

A preferred embodiment of the invention provides that the two plastic sectional rod portions are held together by means of a snap-in or locking device and that the connection device is at the same time a holding device for the foil type vapor seal.

According to variant of the invention, one plastic sectional rod portion has essentially the form of a U-bar and the free ends of the legs thereof are formed as one half of the snap-in device, and that one plastic sectional rod portion forms at least a part of a spacer for the panes. The two-piece design of the plastic sectional rods causes not more expensive than the known arrangement since the one plastic sectional rod portion can be utilized as spacer or at least as a part thereof and because, in known multi-pane insulating glasses, the spacer is a separately manufactured part. Regardless of whether the one plastic sectional rod portion forms the entire spacer or a part thereof, the snap-in or locking connection of the two parts of the plastic sectional rods permits the use of like material and, hence, the utilization of a plastic spacer which is much more advantageous than the use of the known aluminum spacers. This is an object of the invention. The other plastic sectional rod portion constitutes the main component of the plastic sectional rod and, hence, of the frame.

In another embodiment of the invention, which provides for the formation of a chamber for a moisture-absorbing agent, the foil type vapor seal is spanned by the central web of the one U-shaped plastic sectional rod portion, leaving a space; the vapor seal is applied on the other plastic section part. Expediently, the contact surface is flat, making it possible to use a flat seal foil preferably an aluminum foil.

An especially advantageous variant of the invention provides that the longitudinal edges of the foil type vapor seal protrude over the lockable connection device of the two plastic sectional rod portions and extend into the interior of the glass-holding grooves. The flexible material of the seal foil permits forming the protruding longitudinal edge in any desired manner and thus to adapt the diffusion path in the region of the glass-holding groove to the requirements. The vapor seal becomes more effective as the length of the vapor diffusion path is increased. The protruding longitudinal edge of the foil type vapor seal extends, advantageously, approximately perpendicular to the plane of the pane into the glass-holding groove, before the panel is inserted. During insertion of the pane into the glass-holding groove, the edge of the pane presses the protruding longitudinal edge of the seal inwardly, so that the two edges abut flat. As an alternative, the seal edge extending into the groove may be bent over inwardly before or simultaneously with the introduction of the adhesive-sealant into the respective glass-holding groove. In a general way, the adhesive-sealant can be applied on the exposed surface of the seal and/or on the base of the glass-holding groove. In all cases, however, there will be at least a film of adhesive-sealant between the edge of the pane and the seal. As the customary adhesive-sealants do not adhere as well on a plastic surface for example, on metal, in the known multi-pane insulating glass the use of an aluminum spacer is customary. The special manner of retaining the seal made of aluminum foil or the formation of protruding longitudinal edges of the seal extending into the glass-holding groove now respectively permit, in a very advantageous manner, the bonding of aluminum and glass despite the use of an all-plastic section for the frame. It is then unnecessary to apply a primer as normally required for plastic, because that function is taken over by the longitudinal edge of the seal. Thus the loosely, clampingly retained seal and the two-piece design of the plastic sectional rod offer the advantage that the step of primer application can be dispensed with while yet obtaining a perfect bond between the panes and the frame. Moreover, the vapor diffusion path is lengthened. Conversely, this design permits the use of plastic, in particular PVC, for the entire frame including the spacer, this being another object of the invention.

According to another variant of the invention, before insertion of the pane, the protruding longitudinal edge of the foil type vapor seal extends at an incline to the plane of the pane in the direction of the mouth of the glass-holding groove, the free rim of the longitudinal edge being spaced from the inner wall of the outer web of the glass-holding groove. This makes possible the introduction of a cord of adhesive-sealants below and above the longitudinal edge of the seal extending into the glass-holding groove. Introduction of adhesive-sealants on both sides of the longitudinal edge of the seal offers the possibility of introducing two kinds of adhesive-sealants into one and the same glass-holding groove. Preferably one places on the bottom of the glass-holding groove a cord or bead of silicone, while on the external surface of the seal edge one applies a bead of a polysulfide, such as marketed under the mark Thiokol (registered trademark) and the like. Silicone has especially good bonding properties, while Thiokol polysulfide is outstanding for its rapid setting. In another variant, the longitudinal edge of the seal extending into the glass-holding groove can be made wider than in the first embodiment and consequently, when the pane is installed, it hugs a larger surface than is the case in the first embodiment. This not only for results in better bonding but also a longer diffusion path, thereby improving the vapor barrier.

In accordance with a further development embodiment of the invention, in particular at the mouth of each glass-holding groove, there is a preferably integrally formed seal strip on both sides, extending into the interior thereof. These seal strips have the function both of centering the pane and of sealing the glass-holding groove from the outside. On the one hand, the penetration of dust and moisture into the glass-holding groove is prevented by these sealing lips, on the other hand they suppress the discharge of adhesive-sealant when the pane is being inserted into the glass-holding groove. Consequently, the adhesive-sealant in the glass-holding groove is subjected by the pane of a compression which ensures that the adhesive-sealant is pushed even into the most remote channel and corner of the glass-holding groove.

Expediently, a first seal strip of each glass-holding groove is molded on at the one plastic sectional rod portion and a second seal strip at the other plastic sectional rod portion, the first seal strip being formed as a soft seal strip and the second as a hard seal strip. As the internal seal strips of each glass-holding groove are softer than the external seal strips, the glass pane can, under the action of the compressive pressure, be displaced toward the soft seal strip and hence toward the spacer. The adhesive-sealant in the gap between pane and spacer is thus under a pressure which is sufficient to completely fill this gap. Another advantage of the use of at least one soft seal strip resides in that the gap formed by the two seal strips is elastically expandable, and thus chipping at the edge of the pane during insertion is prevented. Hence, it is desirable to form the plastic sectional rod in two parts or to use a plastic spacer, because the spacer-side seal strip can be molded on at the spacer. In plastics engineering, it is readily possible today to make one part of the cross-section of a different hardness than the rest of the cross-section. Therefore, the production of the one plastic sectional rod portion or the spacer with the necessary hardness and the molding onto it a comparatively softer seal strip is not a problem. At least the first seal strip has, advantageously, an approximately wedge-shaped form and its extends preferably at an incline into the interior of the glass-holding groove. As soon as the compression in the glass-holding groove increases as the pane is being pressed into it, at least the softer seal strip is lifted by the adhesive-sealant and is thereby pressed against the pane still more firmly.

The lateral walls of the glass-holding grooves are preferably roughened, in particular provided with longitudinal ruts or the like, to obtain a better anchoring of the adhesive-sealant compound. In addition in the case of a fluted or toothed wall, the lower tooth can, in cooperation with the connection device for the two plastic sectional rod portions, be utilized to automatically impart to the protruding longitudinal edge of the vapor seal a predetermined position in the glass-holding groove after the fitting together of the sectional rod portions. This bottom tooth or the like may then serve as deflector or stop for the longitudinal edge of the foil.

In accordance with another feature of the invention at the bottom of each glass-holding groove, there is provided a lengthwise extending support strip or similar supporting device for the pane. This support strip or the like forms a stop at which the forward shifting movement of the pane into the glass-holding groove ends. It assures that at least below a portion of the end face of the pane adhesive-sealant is still present. As the support strip or the like prevents the pane from descending down to the bottom of the glass-holding groove, the multi-pane insulating glass can very advantageously and space-savingly be stored in a vertical position until the adhesive-sealant has set. For this reason, expediently, the application of the sectional rods on the panes take place while the latter are in vertical position, so that even extremely large insulating glass panes can be produced in a minimum of space. The support strip or the like may be disposed on the bottom of the glass-holding groove either centrally or offset to one side, that is, the pane need not necessarily be supported in the central region of its end face.

A special form of realization of the invention is characterized in that the inner wall of each glass-holding groove is formed in its external region by the one plastic sectional rod portion and in its internal region by the other plastic sectional rod portion, on which is also molded the outer wall of each glass-holding groove, and that each web of the other plastic sectional rod portion forms, at the same time, the inner part of the glass-holding groove and a part of an attachment groove for fittings, which groove is open oppositely to the glass-holding groove. One obtains in this way an especially narrow stout profile and a very low frame of the multi-pane insulating glass. A very important feature of the multi-pane insulating glass whose frame consists of miter-jointed plastic sectional rods is to be seen in that at each miter face the glass-holding grooves are interconnected through a cross channel accessible from the outside. As the panes are being inserted, the glass-holding grooves are filled by the adhesive-sealant up to their miter ends, so that sealing problems do not occur at this point. Accordingly the critical point is merely the connection of the two miter faces. Now if one connects the two glass-holding grooves at each corner through a cross channel, a fluid hardenable sealant can be introduced, e.g. injected, through the latter's bore leading outward. It fills the entire cross channel and at the same time closes the associated ends of the chambers for the moisture-absorbing material of the longitudinal and transverse rods of this corner. Actually these rods are glued together also at the miter faces and held together with additional elements if necessary, so that access of moisture through the miter faces is not to be feared. If moisture or water vapor should nevertheless penetrate through the material at this point, it is prevented from advancing further by the sealant in the cross channel. Thus, the moisture-absorbing material is also protected against wetting from the outside.

In accordance with a further development of the invention, for the formation of the cross channel, the miter-side ends of the U-legs of the one plastic sectional rod portion are provided with a recess at their region associated with the chamber for moisture-absorbing agent and the recess is closed at its two ends by a plug or the like, each plug forming a wall of the cross channel. The plug not only prevents the penetration of the subsequently injected sealing material between the grains of the moisture-absorbing agent, it also establishes the condition for the creation of a sufficient pressure in the injected sealing material, so that the latter squeezes into every last crack and thus ensures a hundred percent seal in this region.

Advantageously each cross channel is accessible through a bore and is filled with a sprayable sealant.

The invention also relates to a method for the production of the multi-pane insulating glass having at least two parallel panes which are surrounded by a frame with miter faces made of plastic sectional rods, each pane engaging by its edge in a glass-holding groove of the frame, and an adhesive-sealant being present between at least a part of the groove wall and the pane engaging therein, and the frame having a foil type vapor seal at least in the region of the space between the panes.

In this respect, a method for the production of this multi-pane insulating glass which makes possible, with the use of simple and cheap basic elements, a quick, problem-free, space-saving manufacture which meets the requirements of high quality of the framed multi-pane insulating glass.

Accordingly, the method according to the invention provides a technique for producing a multi-pane insulating glass as set forth above, characterized in that the vapor seal is brought between the two plastic sectional rod portions of each two-piece sectional rod and is retained as the two sectional rod portions are joined, in particular clipped together, that then the adhesive-sealant is introduced into each glass-holding groove of the four sectional rods forming the frame and subsequently the four sectional rods are connected with the cleaned panes held spaced, and that thereupon the cross channels interconnecting the glass-holding grooves at the miter faces are spray-filled with a sealant. The plastic sectional rods or rod portions can be manufactured in a simple manner by extrusion, preferably from PVC (polyvinyl chloride). When clipping on the one sectional rod portion, which at least in part serves as spacer, simultaneously the vapor seal, preferably consisting of an aluminum foil, is attached. Preferably the application of the sectional rods to the cleaned and spaced panes is effected by retaining one of these sectional rods in suitable manner and mounting the panes on it in vertical position. Thereafter, the remaining three sectional rods are slipped onto the previously formed unit. The adhesive-sealant previously introduced, in particular injected, into the glass-holding grooves, is displaced by the penetrating edge of the panes, so that it fills the entire glass-holding groove. After setting, there results a firm, tight bond between the sectional rods and the panes. To avoid the penetration of moisture into the space between the panes via the miter faces, sealant is injected into the four cross channels interconnecting the glass-holding grooves at the miter faces at a pressure such that it completely fills these cross channels. Until the sealant and the adhesive-sealant have set in the glass-holding grooves, the sectional rods are firmly held together by suitable devices.

The loose plastic sectional rods are expediently miter-jointed after the fitting together of the plastic sectional rod portions, so that there result smooth, continuous miter faces and the foil type vapor seal extends into the miter faces.

A further development of the invention is characterized in that for the establishment of a connection between each glass-holding groove and the associated end of the cross channel for the sealant, the end faces of the plastic sectional rods, which serve as spacers, are provided with a recess on both sides. One can provide the recesses for example by reducing the end faces of the rod portion at the respective points by milling, or the recess may be machined in by stamping.

Another realization of the invention is characterized in that the one plastic sectional rod portion of the loose rods, which at least in part forms a spacer, is provided with holes, which are stamped in in particular after the fitting together. Stamping in the assembled state is possible because the respective face of the one sectional rod portion is sufficiently spaced from the other sectional rod portion preferably parallel thereto, which spacing is necessary for the formation of a chamber for the moisture-absorbing agent.

Preferably web recesses, bores and the like for fittings are provided on the plastic sectional rods before introduction of the adhesive-sealant. The execution of this operation on the loose sectional rods is important for the reason that the web recesses and the like are used for example also for the insertion of holding elements with which the sectional rods are held together during the setting of the adhesive-sealant.

In a further development of the invention, a moisture-absorbing agent is filled into the chamber formed by the vapor seal and the one plastic sectional rod portion and closed at one end by a plug, and that thereupon also the other end of the chamber is closed with a plug. It is expedient to introduce the moisture-absorbing agent into the chambers of the frame before the formation thereof, because then a filling hole going to the outside can be dispensed with, the tight closing of which would require an expensive operation. Besides, the complete filling of the chamber of each individual sectional rod is easier to carry out reliably than the filling of a chamber circling the entire finished frame.

An advantageous development of the invention is characterized in that the protruding longitudinal edges of the vapor seal extending into the glass-holding grooves are bent over into the interior of their glass-holding groove at least to a large extent before the adhesive-sealant is introduced. This ensures that in the final mounted position of the panes they occupy their intended position correctly, and on the other hand the introduction of the adhesive-sealant is thereby facilitated.

Another variant of the invention is characterized in that to both sides of the protruding longitudinal edge of the vapor seal extending into each glass-holding groove a cord of adhesive-sealant is introduced, in particular injected, and thereafter these longitudinal edges are pressed into the glass-holding groove by the entering edge of the pane, hugging the latter. As the two central cords of adhesive-sealant are separated from each other by the longitudinal edge of the vapor seal, different adhesive-sealants can be used. In this case, in the final installed position of the pane, a different adhesive-sealant will be present, for example, at its outward surface than on its inward surface. This may be of advantage with respect to the vapor diffusion tightness, the performance of this adhesive-sealant layer during subsequent use of the insulating glass, and also with regard to the joining of the various materials by the adhesive-sealant. If desired, the longitudinal edge of the seal may be bent downward a little after the lower adhesive-sealant cord has been introduced. However, it is not absolutely necessary to introduce different adhesive-sealants on both sides of the lengthwise edge of the seal; they may be two cords of the same material.

A further realization of the invention provides that the panes are inserted into the lower plastic sectional rod in approximately vertical position and afterwards the three remaining sectional rods are plugged onto the free pane edges.

As the panes are being pressed into the glass-holding grooves, the adhesive-sealant is displaced and also a small amount can come out at the miter faces. It is therefore normally unnecessary to spread adhesive-sealant on the miter faces. Because it takes a while for the adhesive-sealant to reach its final state and to set, the sectional rods must be held together in a suitable manner to assure a tight corner connection. To this end, it is proposed in further development of the invention that the corners of the frame formed by plastic sectional rods are held together by means of in particular pluggable and/or lockable corner brackets, the corner brackets being fastened before the sealant is injected. The latter is injected into the longitudinal channel connecting the two glass-holding grooves in the miter region. Firm pressing together of the miter faces presupposes a correspondingly exact formation of these corner brackets and exact recesses, in particular snap-in recesses or the like. If one chooses a locking or hooking connection of the corner brackets with the two sectional rods of this corner, one can dispense with special attachment elements for the corner bracket, as for example screws or the like. By making the corner bracket especially small, which in itself is advantageous, and by correlating it for example with the region of the one pane, it may be advantageous to provide also in the region of the other pane an element which holds the sectional rods together at this point. For this reason, a development of the invention provides that additionally or alternatively to the corner bracket an additional bracket, in particular a plastic bracket, is inserted into an outer attachment groove and is connected with the frame preferably by ultrasonics, the additional bracket being fastened before the sealant is injected. Both brackets and the like can be inserted in suitable grooves of the sectional rods, which can easily be molded on during extrusion of the PVC sectional rods.

Lastly, for the formation of a window panel, window fittings are advantageously mounted to the frame mounted. Due to the use of sectional rods this is made easily possible, in particular, due to the use of previously made stampings and the like. Also it is no problem to insert packings into suitable continuous grooves of this panel.

Accordingly, it is an object of the invention to provide an improved multi-pane insulating glass arrangement of the type having at least two parallel panes, a frame, the frame including a plurality of elongated plastic sectional rods interconnected at each end and mounted along the edges of the panes, the sectional rods having walls defining an elongated pane holding groove, each pane having edges engageably received in the holding grooves of the frame, an adhesive sealant mounted between at least a portion of a wall of the sectional rod defining the groove and the pane engaged therein, and a foil type vapor seal mounted between the pane. The improvement, in accordance with the invention, resides in the provision of plastic sectional rods comprising a first sectional rod portion and a second sectional rod portion, the first sectional rod portion overlying at least part of the second sectional rod portion intermediate the parallel pane, and the foil type vapor seal being mounted intermediate the first and second sectional rod portions. Preferably, means are provided for concurrently connecting the first and second sectional rod portions and retaining the foil type vapor seal intermediate the sectional rod portions. In accordance with the inventive technique, a method is provided for producing a multi-pane insulating glass arrangement of the type described which includes the steps of providing the first and second sectional rod portions in the aforesaid overlying relationship, locking the first and second sectional rod portions together, introducing an adhesive sealant into the groove and subsequently mounting the pane into the groove, and then spray-filling the groove at the miter faces of the adjacent ends of the sectional rod portions.

It is a further object of the invention to provide a multi-pane insulating arrangement and method for producing such which is simple in construction, easy to fabricate and economical.

BRIEF DESCRIPTION OF THE DRAWINGS

In the drawing, embodiments of the invention are illustrated, with reference to which also the method according to the invention is explained.

DETAILED DESCRIPTION

Figure 4:
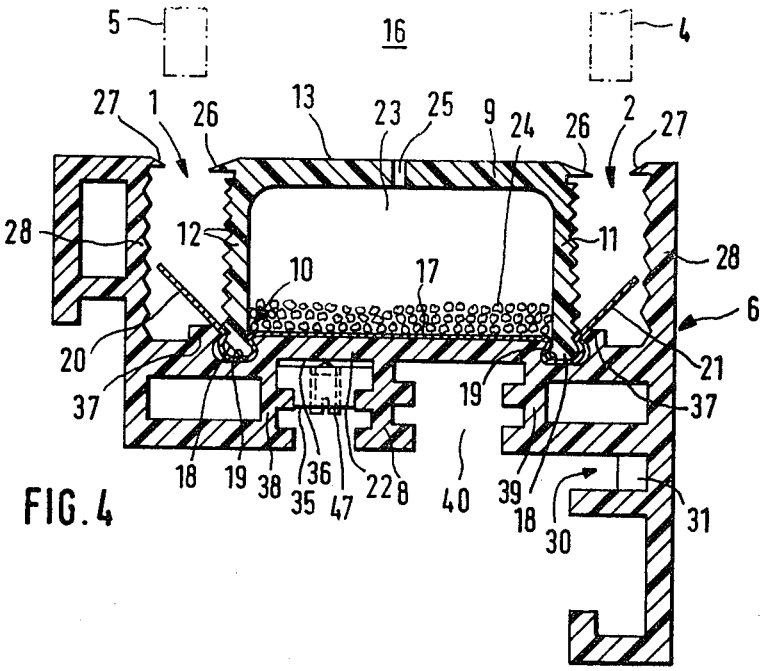
FIG. 4, is a section along line IV—IV of FIG. 1.
Figure 5:
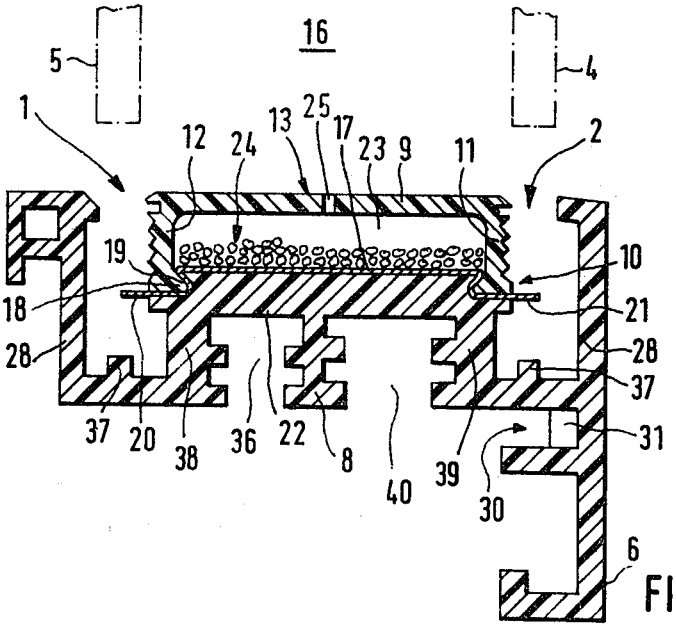
FIG. 5, is the same section, similar to FIG. 4, of another embodiment.

The framed multi-pane insulating glass is composed of two panes 4, 5 engaging by their edges in glass-holding grooves 1, 2 of a frame 3. Frame 3 is formed by four miter-cut plastic sectional rods 6 and 7, at least pairs of which are of equal length. Each plastic sectional rod 6, 7, in turn, is composed of plastic sectional rod portions 8 and 9, which are held together by means of a snapping or locking connection device 10. The one plastic sectional rod portion 9 has substantially U-shaped cross-section and forms, in the embodiment of FIG. 4 the inner flank of the glass-holding grooves 1 and 2. In FIG. 5, the two U-legs 11 and 12 are made somewhat shorter, for which reason the one plastic sectional rod portion 9 forms only the outer half of the inner flank of the two glass-holding grooves 1 and 2. The other sectional rod portion 8 constitutes the essential part of the plastic sectional rod 6, 7. Accordingly, therefore, the one plastic sectional rod portion 9 forms a spacer 13 (FIG. 4) or at least the essential part of a spacer 13 (FIG. 5) for the two panes 4 and 5.

The panes 4 and 5 and the plastic sectional rods 6 and 7 are held together by means of an adhesive-sealant 14. In a preferred form of realization, two different adhesive-sealants 14 and 15 may be used, in which case preferably silicone and Thiokol polysulfide are used. Particulars concerning this will be explained below.

Since plastic, and in particular the PVC here used preferably, is not water vaporproof, and since no water vapor should penetrate into the space 16 between the two panes 4 and 5 from the outside, because the panes 4, 5 would fog up on the inside, a vapor seal 17 must be installed. It consists preferably of an aluminum foil. To retain the aluminum foil, one uses in very advantageous manner the connection device 10, by which the one plastic sectional rod portion 9 serving as spacer 13 is detachably fastened to the other plastic sectional rod portion 8. The connection device 10 consists, for example, of a thickened free end 18 of each U-leg 11, 12 of the one plastic sectional rod portion 9 and of an outwardly narrowing longitudinal locking groove 19 of the other sectional rod portion 8. Conceivable also are modified forms, as the drawings show. Now the width of the vapor seal 17 is chosen greater than the spacing of the two locking longitudinal grooves 19 or the like, so that the lengthwise edges 20 and 21 protrude over the connection device 10 and extend into the interior of the glass-holding groove 1, 2. Depending on the form given, the longitudinal edge 20, 21 extends perpendicular to the median plane of the glass-holding groove 1, 2 or respectively to the plane of pane 4, 5 (FIG. 5) or obliquely inclined thereto, the free end of the longitudinal edge pointing outward (FIGS. 4, 6 and 7).

The part of the vapor seal 17 located between the two connection devices 10 of the rod portions 8, 9 rests on a plane web 22 of the other rod portion 8. This covered web 22 forms the lower limit of a chamber 23 of preferably rectangular cross-section for a moisture-absorbing agent 24. It communicates with the space 16 situated between the panes 4, 5 via preferably punched holes 25 in the central web of the one plastic sectional rod portion 9. The air enclosed between the panes 4, 5 and the spacer 13 during manufacture can yield its moisture to this agent 24, for which reason no fogging of the inner pane surfaces occurs.

At the mouth of each glass-holding groove 1, 2 there is, on either side, a seal strip 26, 27 extending into the interior thereof (FIG. 4), seal strip 26 being molded on at one plastic sectional rod portion 9, while seal strip 27 is made in one piece with the other plastic sectional rod portion 8. The first seal strip 26 is formed as a so-called soft seal strip, i.e. it consists of softer material than rod portion 9. By contrast, the hardness of the second seal strip 27 is at least approximately identical with that of rod portion 8 and preferably also with that of rod portion 9. At least the first seal strip 26 has a wedge-shaped cross-section. In addition, the gap between the two seal strips 26, 27 is narrower than the thickness of pane 4, 5, so that the elastically flexible first seal strip 26 is bent over inwardly as the pane 4, 5 is being pressed into its glass-holding groove 1, 2. During insertion into the glass-holding groove 1, 2, the free edge of the pane displaces the adhesive-sealant 14 or 14 and 15 present therein, so that it rises up along the groove wall of the glass-holding groove 1, 2. The two seal strips 26 and 27 also prevent the adhesive-sealant 14, 15 from coming out of the respective groove. By the compression resulting in the interior of the glass-holding groove 1, 2, the adhesive-sealant 14, 15 is pressed into all cracks and, moreover, the inwardly bent seal strip 26 is also firmly pressed against the associated area of the pane edge. If the pressure between the pane 4, 5 and the outer web 28 of the glass-holding groove 1, 2 is greater than the pressure on the other side of the pane 4, 5, the latter gives way toward the spacer 13. This is possible due to the elastic property of the seal strip 26. The walls of the glass-holding grooves 1, 2 are toothed, roughened, or made uneven in a similar manner. One achieves thereby both a surface enlargement and a better anchoring of the adhesive-sealant 14, 15 in the glass-holding groove 1, 2.

Figure 6:
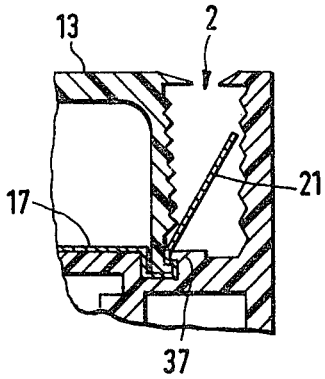
FIG. 6, is a section through the glass-holding groove of a further form of the inventive arrangement with slanting longitudinal edges of the seal.
Figure 7:
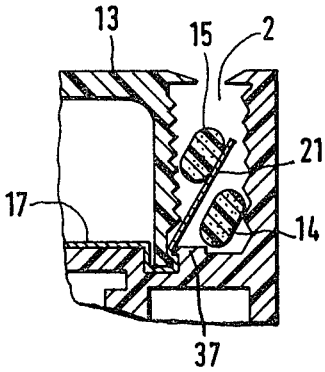
FIG. 7, is a representation according to FIG. 6 after introduction of the sealing adhesive.
Figure 8:
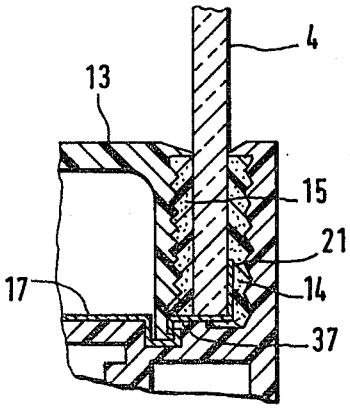
FIG. 8, is a representation according to FIG. 7, but with the pane inserted.

In the embodiment of FIGS. 6 to 8, first one applies on the groove bottom a cord of adhesive-sealant 14 which preferably consists of silicone. Thereafter one can push the protruding longitudinal edge 21 of the vapor seal 17 a little farther down and install a second cord of an adhesive-sealant 15 of polysulfide above the longitudinal edge 21. If thereupon one pushes the edge of the pane into the glass-holding groove 2, a silicone layer will be present in the glass-holding groove 2 below the now angularly bent longitudinal edge 21 and to the right of the pane 4, while the space 16 between pane 4 and spacer 13 is filled with polysulfide, such as that marketed under the trademark Thiokol (reg. trademark). The latter bonds especially well with the plastic as well as with the glass and the material of the vapor seal 17, e.g. aluminum. As the edge of pane 4 is pushed directly against the polysulfide, there will form between the bent longitudinal edge 21 of the vapor seal 17 and the pane 4 a thin polysulfide layer, which ensures a vaporproof union between pane 4 and vapor seal 17. In addition, one obtains through the bent longitudinal edge 21 a comparatively long barrier distance. The good bonding properties of the Thiokol or of a comparative adhesive-sealant save the application of a so-called primer at this point.

In the embodiment of FIG. 5 actually only the use of a single adhesive-sealant, e.g. silicone, is provided. This, too, is applied in the form of a cord on the groove bottom, the longitudinal edge 20, 21 of seal 17 being bent toward the groove bottom simultaneously or a little before. This longitudinal edge 21 assumes the final form as the pane 4, 5 is being inserted. Depending on the longitudinal edges 20 or 21, the latter hug not only the inner face of pane 4, 5 but also its end face and the outer face of pane 4, 5 as well.

Figure 3:
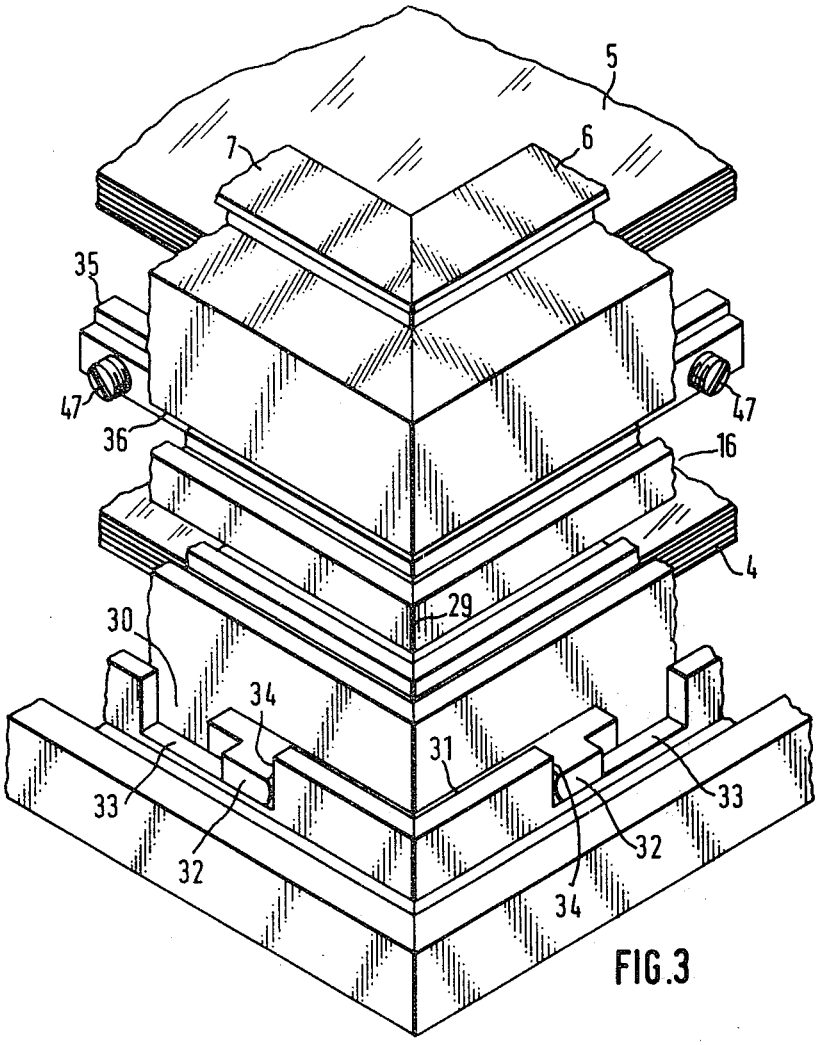
FIG. 3, is a perspective view of the corner shown in FIG. 1, with corner connection means.

The adhesive-sealant 14, 15 can emerge a little at the miter faces 29, and this suffices during the subsequent formation of the frame 3 for the tight connection of the mutually facing ends of the sectional rods 6, 7 forming the stringers. However, in order to ensure the mutual correlation of the sectional rod ends at these miter faces 29 during the setting of the adhesive-sealant 14, 15, there is inserted into a frame groove 30 of each corner a corner bracket 31, which carries at each of its legs a shoulder 32 which engages in a web recess 33 and takes support on the edge 34 of recess 33 adjacent to the miter face 29 (FIG. 3). These corner brackets 31 pull the miter faces 29 firmly against one another. As the corner brackets 31 are located in the region of the glass-holding groove 2, it is advantageous to provide special elements also in the region of the glass-holding groove, 1. For this purpose additional brackets 35 are used at the four corners, which may consist in particular of plastic. They are inserted in an attachment groove 36 and preferably connected with the plastic sectional rods 6, 7 by supersonic welding. In FIG. 3 these brackets 35 consist of metal and are threaded for the screwing in of bolts 47.

On the bottom of the glass-holding grooves 1, 2 there is a longitudinally extending support strip 37, on which the fully inserted pane 4 or 5 takes support. It can be arranged and dimensioned so that the pane 4, 5 can be placed against it, but between a part of the end face of the pane and the groove bottom there remains a layer of adhesive-sealant 14, 15. Thus, the setting of the adhesive-sealant 14, 15 can take place with the insulating glass standing upright. Expediently, therefore, one fits the frame 3 to the vertically standing panes 4, 5.

The webs 38 and 39 of the one plastic sectional rod portion 8 form in FIG. 5 a part of the glass-holding groove 1, 2 and at the same time also the outer flank of the attachment grooves 36, 40 for fittings not shown, which one inserts there, e.g. clips in, when the framed multi-pane insulating glass is used as a window panel.

Figure 1:
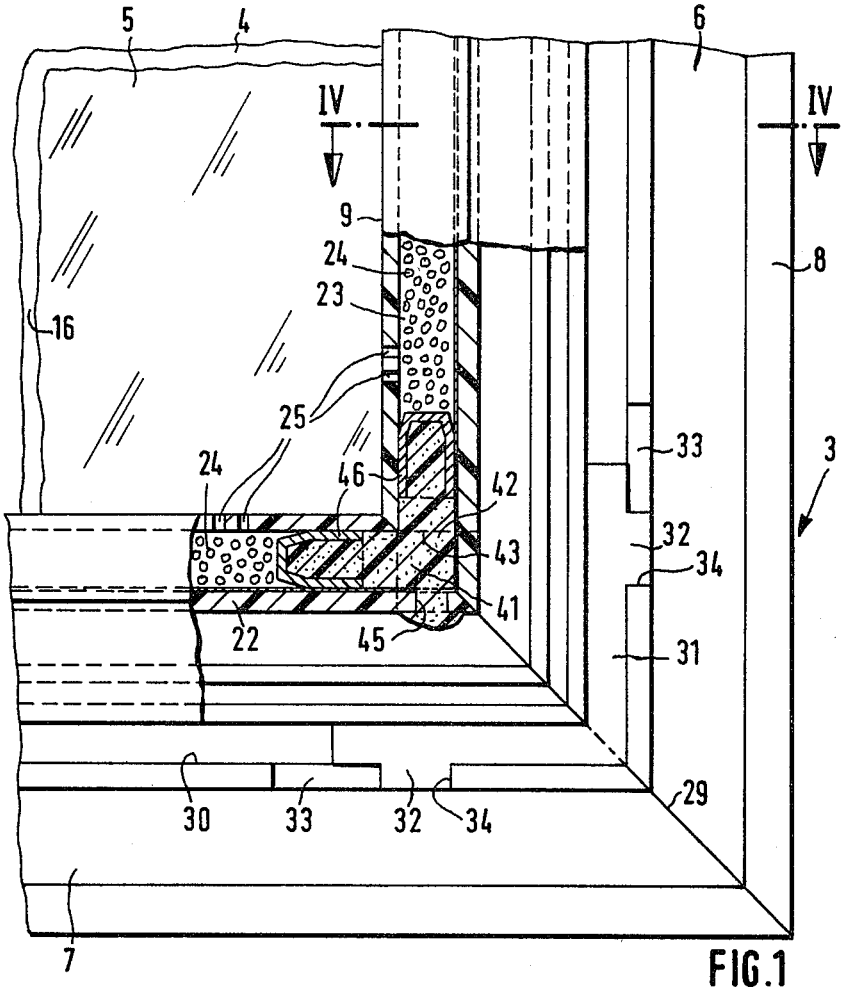
FIG. 1 shows a plan view of a corner of a framed multi-pane insulating glass, partly in section.
Figure 2:
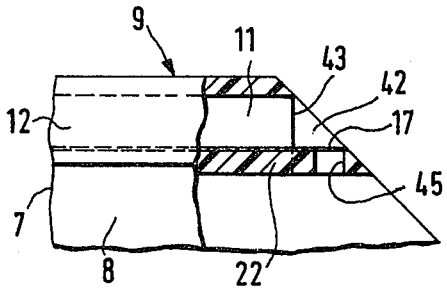
FIG. 2, is a side view, partly in section, of one end of the one plastic sectional rod of FIG. 1, broken off.

Despite the use of plastic, in particular PVC, for the entire frame 3, the penetration of water vapor into space 16 between the panes 4 and 5 is not possible because of the favorable arrangement and formation of the vapor seal 17. Critical points, however, are the miter faces 29. In order to achieve a reliable vapor seal also there, the two glass-holding grooves 1, 2 of the two rod ends of each corner are bridged by a sprayable sealant 41. It is introduced at such pressure that it squeezes into all cracks of this region and thus securely seals the miter face 29 on the inside. To create a cross channel 42, the two U-legs 11, 12 of the plastic sectional rod portion 9 are, according to FIG. 2, provided in the miter region with recesses 43 which extend up to the vapor seal 17. Thus the sealant 41 can apply also against the inward face of seal 17. To be able to inject the sealant 41 from outside, web 22 of at least one of the two rod ends has a bore 45, at which an appropriate spray nozzle can be applied. When the cross channel 42 is completely filled and a certain pressure has built up in its interior, one removes the spray nozzle, owing to which then also bore 45 fills up, as FIG. 1 of the drawing illustrates. In order that the sealant 41 will not be able to penetrate between the grains of the moisture-absorbing agent 24, the two ends of chamber 23 associated with each corner are closed by a plug 46 for each. The latter has a cap type form, the opening being correlated with the cross channel 42, so that also plug 46 can fill up with sealant 41. Thus the two plugs 46 limit at the same time also the cross channel 42.

In the following, the method of production of this framed multi-pane insulating glass is briefly explained.

First the plastic section rods 6, 7 or rod portions 8, 9 are produced by extrusion and brought to the necessary length. The two ends having been miter-cut, one places the vapor seal 17 consisting of an aluminum foil on web 22 of rod portion 8. Then the rod portion 9 is placed over it, and the two rod portions 8, 9 clipped together by locking of the connection devices 10. Another possibility is to start with so-called meter stock, that is, sectional rod bars for example six meters long, in which the seal 17 is already applied, and then cut to length. The advantage of this is that, after cutting to length or miter sawing, it is not necessary to rework the vapor seal 17.

Then the recesses 43 are provided on the two miter ends by milling, e.g. by means of an end mill. Thereupon the one plastic sectional rod portion 9 is provided with the holes 25. The holes 25 can be drilled or preferably also punched without using a bottom die. Thereafter the recesses for later attachment of fittings and the like are provided on rod portion 8, as are the web recesses 33 and bore 45.

After the moisture-absorbing agent 24 has been filled in, the two ends of each chamber 23 are closed with the aid of a plug 46 for each.

Then, into each of the glass-holding grooves 1, 2, at least one cord of adhesive-sealant 14, 15 is introduced. To the extent necessary, simultaneously or before, or in the case of two cords possibly after the lower cord has been introduced, the longitudinal edge 21 of the vapor seal 17 protruding over the connection device 10 is bent over or at least bent forward.

Into an opening of a glass rack one now places the thus prepared plastic sectional rod 7. Thereupon the two cleaned and dried panes 4, 5 are supplied to the glass rack with the given spacing and preferably standing on edge. After the panes 4, 5 and the lower sectional rod 7 have been aligned, they are fitted together. When the final position shown in FIG. 8 has been reached, the glass-holding grooves 1, 2 are completely filled with adhesive-sealant 14, 15. Then one plugs the right and the left plastic sectional rod 6 onto the previously formed unit and in the end one applies also the upper plastic sectional rod 7. At the miter faces 29 normally enough adhesive-sealant 14, 15 is present to securely seal the miter faces 29.

In order, on the one hand, to secure the corner connections and, on the other, to press the miter faces 29 firmly on one another, in a further operation the four corner brackets 31 are pressed into the frame groove 30. If space permits, this operation can be carried out in horizontal position of the framed insulating glass on an appropriate mounting table. The same applies also to the subsequent injection of the sealant 41 at the four corners through the bores 45. The setting of the adhesive-sealant 14, 15 takes place advantageously again in vertical position, to save space. This is readily possible by using the support strips 37. Lastly one applies fittings as needed, for example when the framed insulating glass is to be used as a window panel. After packing it is ready for shipping.

I claim:

1. An improved multi-pane insulating glass arrangement of the type having at least two parallel panes, a frame, the frame including a plurality of elongated plastic sectional rods interconnected at each end, the sectional rods having walls defining an elongated pane holding groove, each pane having edges engageably received in the holding grooves of the frame, an adhesive sealant mounted between at least a portion of a wall of the sectional rod defining the groove and the pane engaged therein, and a foil type vapor seal mounted between the panes, the improvement wherein each of the plastic sectional rods comprises a first sectional rod portion and a second sectional rod portion, said first sectional rod portion overlying at least part of said second sectional rod portion intermediate the parallel panes, and the foil type vapor seal being mounted intermediate the first and second sectional rod portions.

2. An improved arrangement, as set forth in claim 1, further comprising means for concurrently connecting said first and second sectional rod portions and retaining the foil type vapor seal intermediate said first and second sectional rod portions.

3. An improved arrangement, as set forth in claim 2, wherein said first sectional rod portion has substantially a U-shaped cross section, said U-shaped cross section comprising U-leg having three ends each forming one-half of said connecting and retaining means, and wherein said first sectional rod portion comprises a spacer for spacing the panes.

4. An improved arrangement, as set forth in claim 3, wherein said U-shaped cross-section has a central web connecting the U-legs and spanning the foil type vapor seal at a spaced distance therefrom to form a chamber for housing a moisture-absorbing agent, and wherein the vapor seal lies on the second sectional rod portion.

5. An improved arrangement, as set forth in claim 2, wherein the foil type vapor seal has lengthwise edges which traverse said connecting and retaining means and project into the interior of the holding groove.

6. An improved arrangement, as set forth in claim 3, wherein the foil type vapor seal has lengthwise edges which traverse said connecting and retaining means and project into the interior of the holding groove.

7. An improved arrangement, as set forth in claim 4, wherein the foil type vapor seal has lengthwise edges which traverse said connecting and retaining means and project into the interior of the holding groove.

8. An improved arrangement as set forth in claim 4, further comprising a seal strip extending along each elongated edge of the wall of the groove laterally adjacent the pane, each seal strip extending from the edge into the interior of the holding groove.

9. An improved arrangement as set forth in claim 3, further comprising a seal strip extending along each elongated edge of the wall of the groove laterally adjacent the pane, each seal strip extending from the edge into the interior of the holding groove.

10. An improved arrangement as set forth in claim 8, wherein a first seal strip of each holding groove is integrally formed on the first sectional rod portion and a second seal strip is integrally formed on the second sectional rod portion, said first seal strip being softer than said second seal strip.

11. An improved arangement, as set forth in claim 10, wherein at least the said first seal strip has an approximately wedge-shaped form and extends at an incline into the interior of the holding groove.

12. An improved arrangement, as set forth in claim 11, wherein the walls of the holding groove laterally abutting the pane comprise roughened surfaces.

13. An improved arrangement as set forth in claim 12, wherein said roughened surfaces comprise a plurality of longitudinal rods extending within the walls.

14. An improved arrangement, as set forth in claim 13, further comprising a longitudinally extending strip supporting the pane.

15. An improved arrangement as set forth in claim 14, wherein said first sectional rod portion comprises an inside wall of the holding groove and said sectional rod portion comprises a bottom wall and an outer wall of the holding groove, said outer wall being mounted on said bottom wall, and wherein said second sectional rod portion on the side opposite said chamber includes wall means projecting therefrom to define an attachment groove for fittings, said attachment groove being open oppositely to the holding groove.

16. An improved arrangement as set forth in claim 14, wherein said first sectional rod portion comprises an inside wall of the holding groove and said sectional rod portion comprises a bottom wall and an outer wall of the holding groove, said outer wall being mounted on said bottom wall, and wherein said second sectional rod portion on the side opposite said chamber includes wall means projecting therefrom to define an attachment groove for fittings, said attachment groove being open oppositely to the holding groove.

17. An improved arrangement as set forth in claim 16, wherein the adjacent ends of the sectional rods are connected in a miter joint, each end comprising a miter face, and one of said sectional rod portions having a cross channel extending therethrough to interconnect said groove adjacent each miter face with the environment outside of said frame.

18. An improved arrangement as set forth in claim 17, wherein each of the U-legs of said first sectional rod portion comprises a recess in the miter face to form said cross channel, and further comprising a plug closing the chamber at the ends thereof adjacent the miter faces.

19. An improved arrangement as set forth in claim 18, further comprising a sealing agent filling said cross channel.

20. An improved arrangement as set forth in claim 19, wherein said second sectional rod portion comprises means defining a laterally disposed frame recess, and further comprising corner bracket means disposed at each corner of the frame having an outwardly projecting shoulder which engages into said recess at each corner.

* * * * *